US008260174B2

(12) United States Patent
Fan et al.

(10) Patent No.: US 8,260,174 B2
(45) Date of Patent: Sep. 4, 2012

(54) MICRO-TIP ARRAY AS A CHARGING DEVICE INCLUDING A SYSTEM OF INTERCONNECTED AIR FLOW CHANNELS

(75) Inventors: Fa-Gung Fan, Fairport, NY (US); Nancy Jia, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 875 days.

(21) Appl. No.: 12/164,392

(22) Filed: Jun. 30, 2008

(65) Prior Publication Data

US 2009/0324289 A1 Dec. 31, 2009

(51) Int. Cl.
*G03G 15/02* (2006.01)

(52) U.S. Cl. ..... 399/168; 399/50

(58) Field of Classification Search ..... 399/50, 399/168; 313/308
See application file for complete search history.

(56) References Cited

U.S. PATENT DOCUMENTS

| | | | | |
|---|---|---|---|---|
| 3,755,704 | A | 8/1973 | Spindt | |
| 3,812,559 | A | 5/1974 | Spindt | |
| 4,721,885 | A * | 1/1988 | Brodie | 313/576 |
| 5,083,958 | A * | 1/1992 | Longo et al. | 445/24 |
| 5,166,709 | A * | 11/1992 | Kubelik | 347/120 |
| 5,194,780 | A | 3/1993 | Meyer | |
| 5,621,272 | A | 4/1997 | Levine | |
| 5,628,661 | A | 5/1997 | Kim | |
| 5,635,791 | A | 6/1997 | Vickers | |
| 5,652,083 | A | 7/1997 | Kumar | |
| 5,662,815 | A | 9/1997 | Kim | |
| 5,735,721 | A | 4/1998 | Choi | |
| 5,759,078 | A | 6/1998 | Levine | |
| 5,842,897 | A * | 12/1998 | Jeong et al. | 445/24 |
| 5,847,407 | A * | 12/1998 | Lucero et al. | 257/10 |
| 5,869,928 | A * | 2/1999 | Liu et al. | 313/495 |
| 6,028,615 | A * | 2/2000 | Pletcher et al. | 347/127 |
| 6,426,233 | B1 | 7/2002 | Knappenberger | |
| 6,890,446 | B2 | 5/2005 | Knappenberger | |
| 6,927,534 | B2 | 8/2005 | Choi | |
| 7,064,476 | B2 | 6/2006 | Cathey | |
| 7,138,760 | B2 | 11/2006 | Kim | |
| 7,156,715 | B2 | 1/2007 | Lee | |
| 7,161,289 | B2 | 1/2007 | Lee | |
| 2006/0280524 | A1 | 12/2006 | Hays | |
| 2007/0237546 | A1 * | 10/2007 | Zona et al. | 399/168 |
| 2009/0224679 | A1 | 9/2009 | Pan | |
| 2009/0303654 | A1 | 12/2009 | Fan | |

* cited by examiner

*Primary Examiner* — Walter L Lindsay, Jr.
*Assistant Examiner* — Billy J Lactaoen
(74) *Attorney, Agent, or Firm* — MH2 Technology Law Group LLP

(57) ABSTRACT

According to various embodiments, there is a charging device including a first conductive layer disposed over a first dielectric layer; a second dielectric layer disposed over a first conductive layer, the second dielectric layer including a plurality of cavities, wherein each of the plurality of cavities exposes a portion of the first conductive layer; a plurality of micro-tips, wherein one of the plurality of micro-tips is disposed within each of the plurality of cavities and on the first conductive layer; a second conductive layer disposed over the second dielectric layer; and a system of interconnected air flow channels disposed in the second dielectric layer and connected to the cavities, such that air injected through an air inlet exits through the plurality of cavities. The charging device can also include one or more power supplies to apply bias voltages to the first and the second conductive layers.

25 Claims, 7 Drawing Sheets

MICRO-TIP ARRAY AS A CHARGING DEVICE INCLUDING A SYSTEM OF INTERCONNECTED AIR FLOW CHANNELS

FIELD OF THE INVENTION

The present invention relates to image forming apparatus and more particularly to charging devices and methods of forming them.

BACKGROUND OF THE INVENTION

In an electrophotographic process, charging devices are needed to uniformly charge various surfaces such as a photoreceptor, toner layer, intermediate belt, and/or media such as, paper. Conventional charging devices use high DC and AC voltages applied to a thin wire or pins to ionize air and produce charged particles (e.g., corotron, dicorotron). However, undesirable species such as ozone that have negative impact on the environment are also created as by-products. Previous efforts in making the charging process environmentally friendly included a bias charging roll process, a contact aquatron charging process, and more recently, a compact charging process with gas ions produced by electric field ionization from carbon nanotubes (CNT). The bias charging roll is a contact charging process. The direct contact of charging roll with photoreceptor causes both surfaces to wear. And even though, the bias charging roll process generates less ozone than a corotron or a dicorotron, it still generates a certain level of ozone. The aquatron charging process is also a contact process. Contact charging is not applicable to developed toner layer as required in an image-on-image development process. Although, CNT (or nanowire) emitter technology has been demonstrated in the literature, the precise fabrication of CNT (or nanowire) arrays at low cost is still in an early stage of research and not yet mature enough for producing reliable nano-charging devices at reasonable cost.

Accordingly, there is a need for a low cost, non-contact, compact, easy to manufacture, and environmentally friendly charging device.

SUMMARY OF THE INVENTION

In accordance with various embodiments, there is a charging device including a first dielectric layer disposed over a substrate, a first conductive layer disposed over the first dielectric layer, and a second dielectric layer disposed over the first conductive layer, the second dielectric layer including a plurality of cavities, wherein each of the plurality of cavities exposes a portion of the first conductive layer. The charging device can also include a plurality of micro-tips, wherein one of the plurality of micro-tips can be disposed within each of the plurality of cavities and on the first conductive layer. The charging device can further include a second conductive layer disposed over the second dielectric layer and a system of interconnected air flow channels disposed in the second dielectric layer and connected to the cavities, such that air injected through an air inlet exits through the plurality of cavities. The charging device can also include one or more power supplies to apply a first bias voltage to the first conductive layer and a second bias voltage to the second conductive layer.

According to various embodiments, there is a method of charging a member. The method can include providing a member to be charged and providing a micro-tip array, the micro-tip array including a first dielectric layer disposed over a substrate, a first conductive layer disposed over the first dielectric layer, and a second dielectric layer disposed over the first conductive layer, the second dielectric layer including a plurality of cavities, wherein each of the plurality of cavities exposes a portion of the first conductive layer. The micro-tip array can also include a plurality of micro-tips, wherein one of the plurality of micro-tips can be disposed within each of the plurality of cavities and on the first conductive layer. The micro-tip array can further include a second conductive layer disposed over the second dielectric layer and a system of interconnected air flow channels disposed in the second dielectric layer and connected to the cavities. The method of charging a member can also include applying a first bias voltage to the first conductive layer and a second bias voltage to the second conductive layer to enable generation of a plurality of charged species and charging the member by depositing the plurality of charged species on the member.

In accordance with various embodiments, there is an image forming apparatus including a receptor to receive an electrostatic charge and at least one charging subsystem for uniformly charging the receptor, the charging subsystem including a first dielectric layer disposed over a substrate, a first conductive layer disposed over the first dielectric layer, and a second dielectric layer disposed over the first conductive layer, the second dielectric layer including a plurality of cavities, wherein each of the plurality of cavities exposes a portion of the first conductive layer. The charging subsystem can also include a plurality of micro-tips, wherein one of the plurality of micro-tips is disposed within each of the plurality of cavities and on the first conductive layer, a second conductive layer disposed over the second dielectric layer, and a system of interconnected air flow channels disposed in the second dielectric layer and connected to the cavities, such that air injected through an air inlet exits through the plurality of cavities. The image forming apparatus can also include at least one imaging subsystem for forming a latent image on the receptor and at least one development subsystem for converting the latent image to a visible image on the receptor. The image forming apparatus can further include a transfer subsystem for transferring the visible image onto a media and a fuser subsystem for fusing the visible image onto the media.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

As used herein, the term "environmentally friendly charging device" refers to any charging device with lower emissions of nitrous oxide and ozone as compared to conventional charging devices, such as, corotron and biased charge roll devices.

Figure 1:
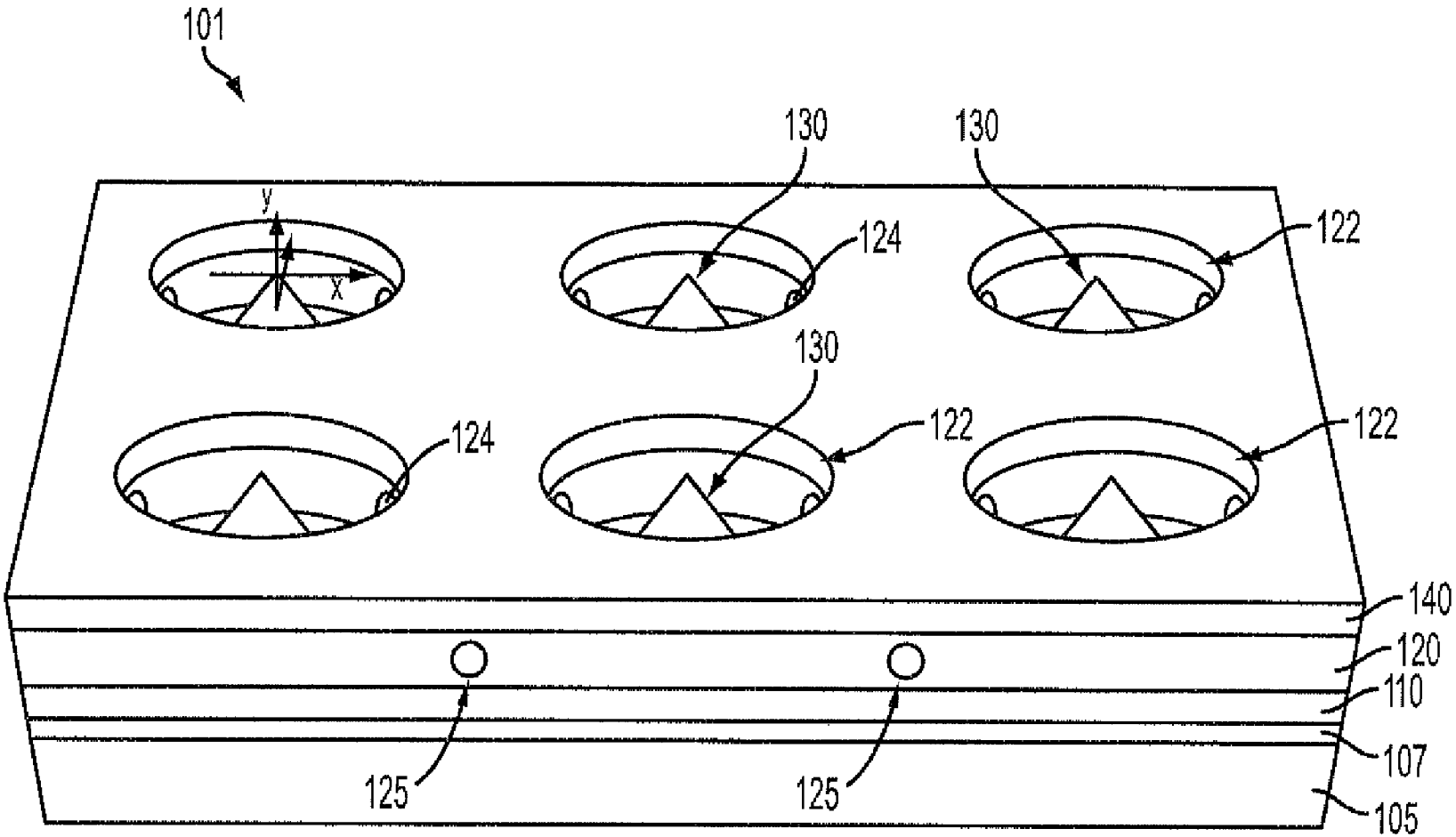
FIG. 1 illustrates an exemplary charging device, according to various embodiments of the present teachings.
Figure 2:
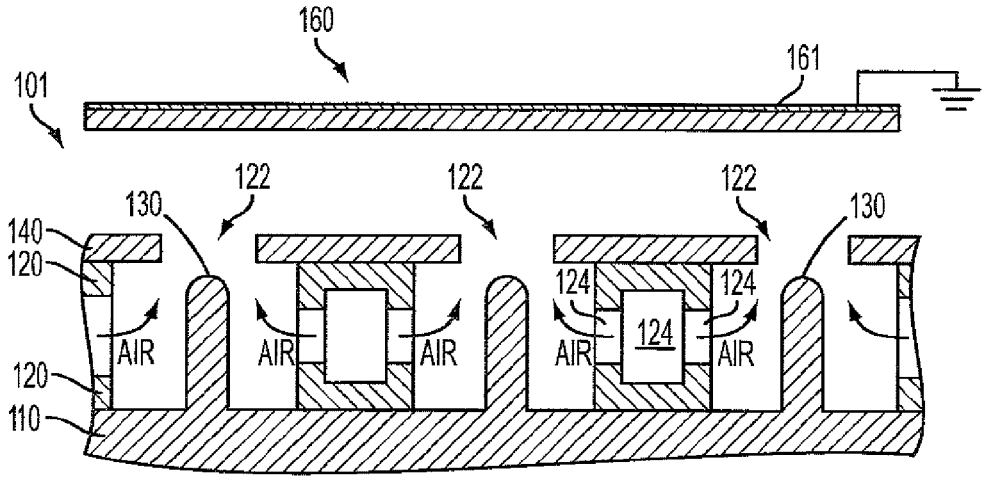
FIG. 2 illustrates a cross sectional view of an exemplary charging device, according to various embodiments of the present teachings.
Figure 3:
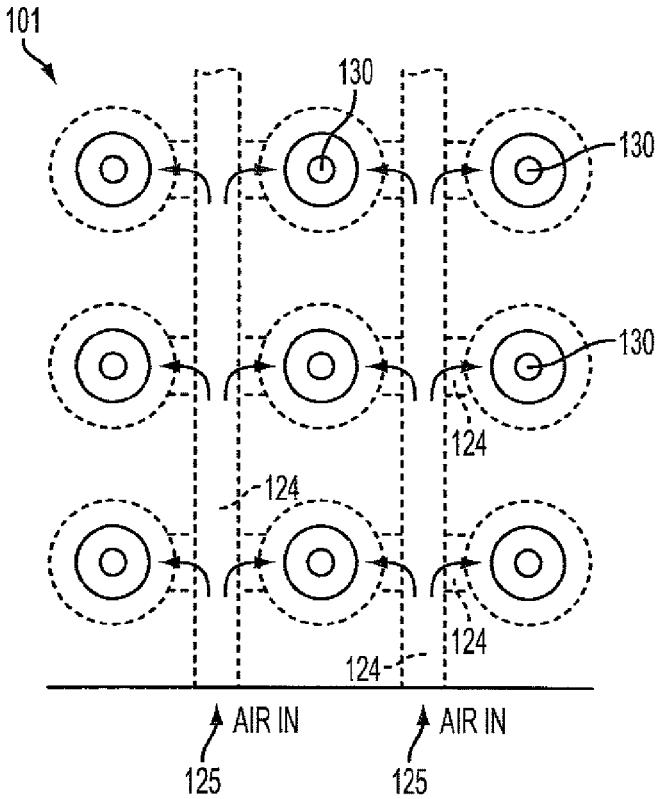
FIG. 3 illustrates a top view of an exemplary charging device, according to various embodiments of the present teachings.
Figure 4A:
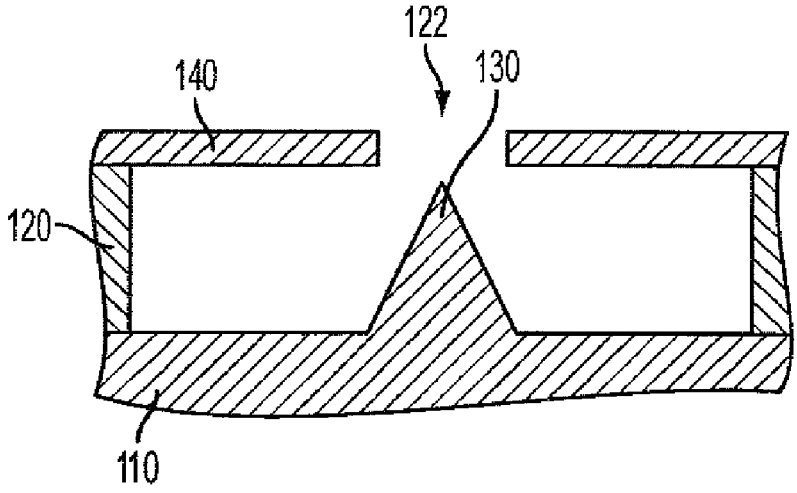
FIGS. 4A-4G illustrate a cross sectional view of exemplary cavities with micro-tips, in accordance with the present teachings.
Figure 4B:
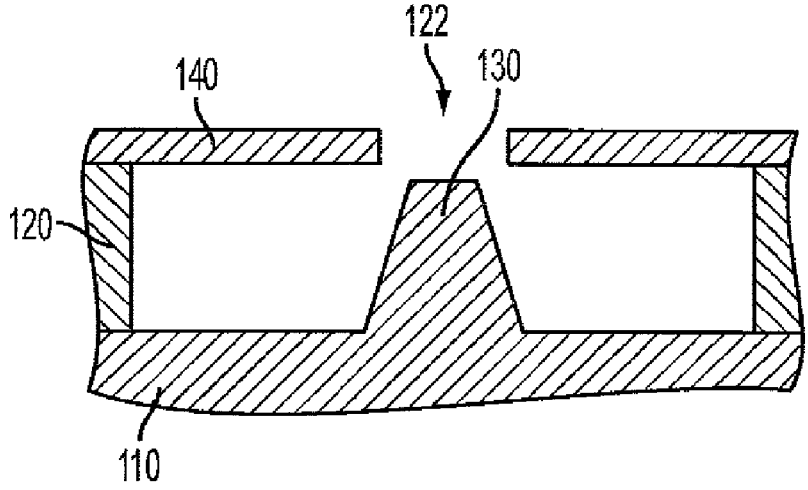
Figure 4C:
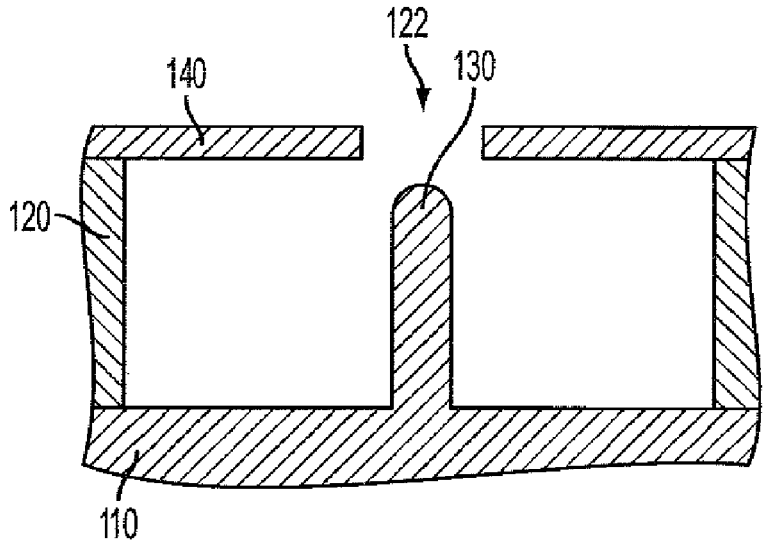
Figure 4D:
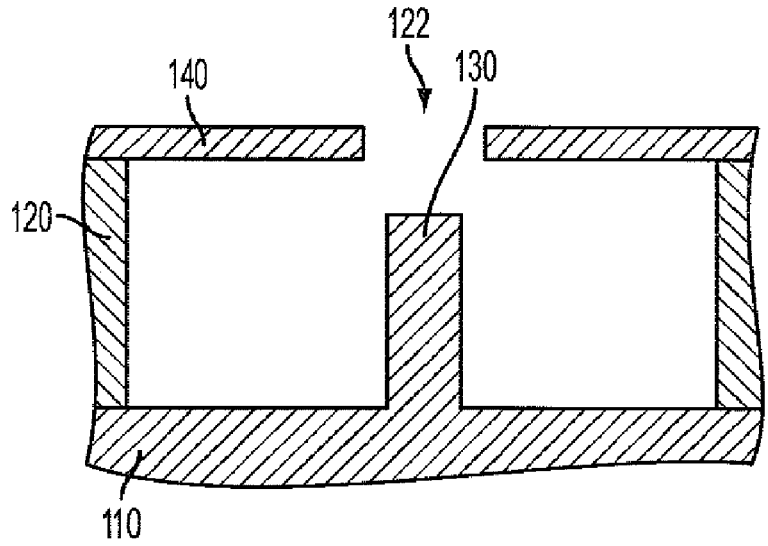
Figure 4E:
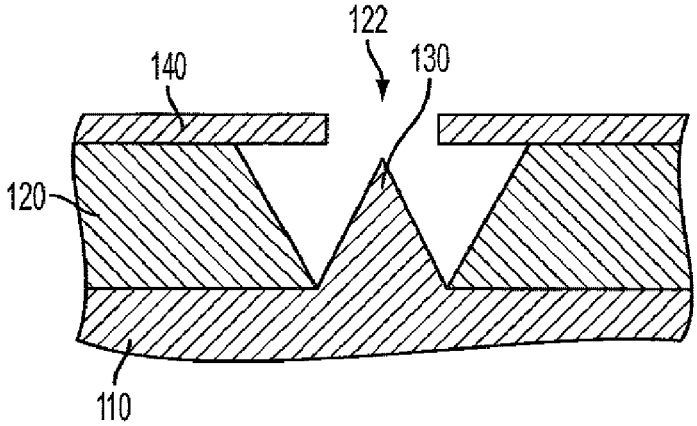
Figure 4F:
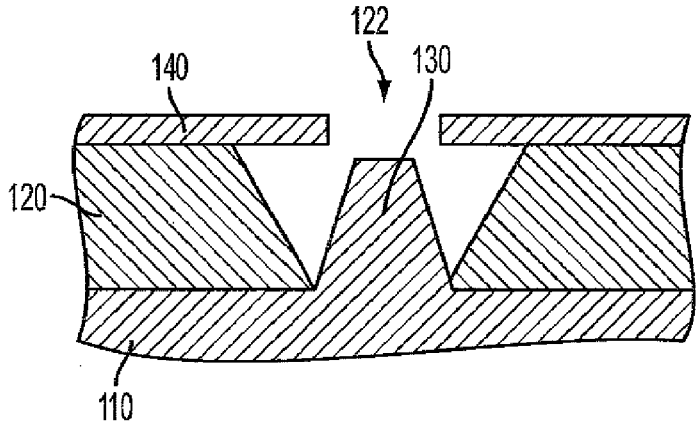
Figure 4G:
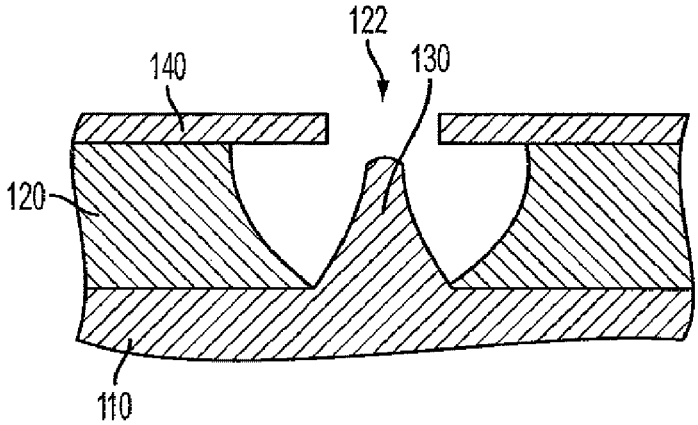

FIGS. 1-3 illustrate an exemplary charging device 101, according to various embodiments of the present teachings. The charging device 101 can include a first dielectric layer 107 disposed over a substrate 105, a first conductive layer 110 disposed over the first dielectric layer 107 and a second dielectric layer 120 disposed over first conductive layer 110. In various embodiments, the dielectric layer 107 electrically isolates the conductive layer 110 from the substrate 105. Exemplary materials for the substrate 105 can include, but are not limited to silicon wafer and glass. Exemplary material for the first dielectric layer 107 can include but is not limited to silicon oxide. Exemplary materials for the first conductive layer 110 can include, but are not limited to metal, doped single crystal silicon or polysilicon. Any suitable material can be used for the second dielectric layer 120, such as, for example, silicon oxide, silicon nitride or a combination of silicon nitride and silicon oxide. As an example, the substrate 105, the first dielectric layer 107 and the first conductive layer 110 can be a sandwich structure made of silicon on insulator (SOI) wafer. The second dielectric layer 120 can include a plurality of cavities 122, wherein each of the plurality of cavities 122 exposes a portion of the first conductive layer 110, as shown in FIGS. 1 and 2. In some embodiments, each of the plurality of cavities 122 can be cylindrical in shape, as shown in FIGS. 1, 2, 3, 4A, 4B, 4C, and 4D. In other embodiments, each of the plurality of cavities 122 can be wedge shaped, as shown in FIGS. 4E and 4F. In yet other embodiments, each of the plurality of cavities 122 can be curved shaped, as shown in FIG. 4G. However, one of ordinary skill in the art would know that each of the plurality of cavities 122 can have any other suitable shape besides a cylindrical, a wedge, and a curve shape. Each of the plurality of cavities 122 can have a diameter from approximately 1 μm to approximately 200 μm, and in some cases from approximately 1 μm to approximately 160 μm, and still in further cases from approximately 1 μm to approximately 100 μm. The spacing between each of the plurality of cavities 122 can be from approximately 3 μm to approximately 1000 μm, and in some cases from approximately 3 μm to approximately 500 μm, and still in further cases from approximately 3 μm to approximately 200 μm.

The charging device 101 can also include a plurality of micro-tips 130, wherein one of the plurality of micro-tips 130 can be disposed within each of the plurality of cavities 122 and on the first conductive layer 110. In some embodiments, each of the plurality of micro-tips 130 can include any metal with a low work function, including, but not limited to, molybdenum and tungsten. In other embodiments, each of the plurality of micro-tips 130 can include any suitable doped semiconductor such as doped silicon or polysilicon. In some embodiments, the micro-tip 130 can be conical, as shown in FIGS. 1, 4A, and 4E. In other embodiments, the micro-tip 130 can be conical with a flat tip, as shown in FIGS. 4B and 4F. In some other embodiments, the micro-tip 130 can be cylindrical, as shown in FIGS. 2, 4C, and 4D. Yet, in certain embodiments, the micro-tip 130 can be cylindrical with flat tip, as shown in FIG. 4D. In yet some other embodiments, the micro-tip can be of general curve shape, as shown in FIG. 4G.

Referring back to the FIGS. 1-3, the charging device 101 can further include a second conductive layer 140 disposed over the second dielectric layer 120 and a system of interconnected air flow channels 124 disposed in the second dielectric layer 120 and connected to the cavities 122, such that air injected through an air inlet 125 exits through the plurality of cavities 122, as shown by arrows in FIGS. 2 and 3. Exemplary materials for the second conductive layer 140 can include, but are not limited to metal, doped single crystal silicon, and doped polysilicon. In various embodiments, the charging device 101 can include a protective coating over the second conductive layer to prevent contamination. In some embodiments, the protective coating can be any suitable material of low surface energy and/or hydrophobic materials, such as, for example, PFA (perfluoroalkoxy), carbon-nanotube doped PFA and non-stick nano-coating materials.

The charging device 101 can also include one or more power supplies (not shown) to apply a first bias voltage to the first conductive layer 110 and a second bias voltage to the second conductive layer 140. In various embodiments, the one or more power supplies can provide at least one of DC power and pulsed DC power. In other embodiments, the one or more power supplies can provide at least one of AC power and biased AC power. Under application of the first bias voltage and the second bias voltage, the micro-tip 130, the second conductive layer 140 and the cavity 122 geometry generates a high electric field at and around a tip of the micro-tip 130, which then emits electrons via field emission. The emitted electrons can collide with air molecules and cause air ionization and corona discharge. For xerographic and/or media charging applications, these emitted electrons and/or the generated ions can be used to charge and build up a surface potential. In some embodiments, there is a device including the charging device 101, wherein the charging device 101 can be used to raise a surface potential of a member, such as, for example, photoreceptor or intermediate belt. In other embodiments, there is a device including the charging device 101, wherein the charging device 101 can be used for media treatment, such as, for example, in paper, toner layer, or ink layer treatment.

In various embodiments, each of the plurality of micro-tips 130 can be individually addressable. In certain embodiments, a group of micro-tips 130 can be selectively addressed. The phrase "individually addressable" as used herein means that each of the plurality of micro-tips 130 can be identified and manipulated independently of its surrounding micro-tip 130, for example, each micro-tip 130 can be individually turned on to emit electrons or off. However in some embodiments, instead of addressing the micro-tips 130 individually, a group of micro-tips 130 including two or more micro-tips 130 can be addressed together, i.e. a group of emitters can be turned on to emit electrons or off together. One of ordinary skill in the art would know that in order to be individually addressable, either the first conductive layer 110 or the second conductive layer 140 or both of each of the plurality of micro-tips 130 must be electrically isolated from the other micro-tips 130.

According to various embodiments, there is a method of charging a member 160. In various embodiments, the member 160 can include a photoreceptor, an intermediate belt, a toner layer, an ink layer, and a media such as, for example, paper or transparency. The method can include providing a member 160 to be charged and providing a micro-tip array 101, as shown in FIG. 2. The micro-tip array 101 can include a first dielectric layer 107 disposed over a substrate 105, a first conductive layer 110 disposed over the first dielectric layer 107, and a second dielectric layer 120 disposed over the first conductive layer 110, the second dielectric layer 120 including a plurality of cavities 122, wherein each of the plurality of cavities 122 exposes a portion of the first conductive layer 110. The micro-tip array 101 can also include a plurality of micro-tips 130, wherein one of the plurality of micro-tips 130 can be disposed within each of the plurality of cavities 122 and on the first conductive layer 110. The micro-tip array 101 can further include a second conductive layer 140 disposed over the second dielectric layer 120 and a system of interconnected air flow channels 124 disposed in the second dielectric layer 120 and connected to the cavities 122, as shown in FIG. 2. In various embodiments, the step of providing a micro-tip array 101 can include fabricating micro-tip array using micro-electromechanical systems (MEMS) fabrication and semiconductor fabrication processes. U.S. Pat. Nos. 3,755,704; 3,812,559; 5,194,780; 5,759,078; 5,635,791; 5,621,272; 6,426,233; 6,890,446; 6,927,534; 7,064,476; 7,138,760; 7,156,715; 7,161,289; 5,662,815; 5,628,661; 5,652,083; 5,735,721, for example, describes in detail the micro-tip arrays and methods of their fabrication, the disclosures of which are incorporated by reference herein in their entirety.

Referring back to the method of charging the member 160, the method can also include applying a first bias voltage to the first conductive layer 110 and a second bias voltage to the second conductive layer 140 to enable generation of a plurality of charged species and charging the member 160 by depositing the plurality of charged species on the member 160. In various embodiments, the step of charging the member 160 can include charging at least one of a photoreceptor, an intermediate belt, a toner layer, an ink layer, and a media such as, for example, paper or transparency. In various embodiments, the step of applying a first bias voltage to the first conductive layer 110 and a second bias voltage to the second conductive layer 140 can include applying a first voltage and a second voltage, wherein a voltage differential between the first voltage and the second voltage can be about 400 V or less and in some cases about 100 V or less and generating a plurality of charges (i.e., electrons and ions) at the end of each of the plurality of micro-tips 130. In some embodiments, the first bias voltage can be one of a DC bias and a pulsed DC bias, and the second bias voltage can be a DC bias. In other embodiments, the first bias voltage can be one of an AC and a biased AC, and the second bias voltage can be a DC bias. In certain embodiments, the method of charging the member 160 can also include grounding a portion of the member 160 before the step of applying the first bias voltage and the second bias voltage. In various embodiments, the member 160 can be a composite member including a front member facing the microtip array and a back member 161 opposite the front member, wherein the front member includes a dielectric/insulating layer and the back member 161 includes a conductive layer. In some embodiments, the step of grounding a portion of the member 160 can include grounding the back member 161 of the member 160 and the charges can then be deposited on a surface of the dielectric layer of the front member and thereby a surface potential of the member 160 can be raised. In various embodiments, the member 160 can be a dielectric layer disposed over a conductive backing plate (not shown). The conductive backing plate can be grounded, and the charges can be deposited on the surface of the dielectric layer. In various embodiments, the method can further include cleaning the micro-tips 130 by injecting air through the air inlet 125 as shown in FIG. 3 and exiting through the plurality of cavities 122, as shown in FIGS. 2 and 3.

In various embodiments, the method of charging the member 160 can include indirect charging of the member 160 as described in U.S. Patent Application Publication No. 2006/0280524 and U.S. patent application Ser. Nos. 12/042,878; 12/132,913, the disclosures of which are incorporated by reference herein in their entirety. In various embodiments, the method of indirect charging of the member 160 can include supplying a gaseous material between the micro-tip array 101 and a counter electrode (not shown), such that application of a first bias voltage to the first conductive layer 110 and a second bias voltage to the second conductive layer 140, and third voltage to the counter electrode (not shown) can ionizes at least a portion of the gaseous material; and directing the ionized gaseous material towards the member 160. In some embodiments, the micro-tip array 101 and a counter electrode can be housed in a channel and the gaseous material can be supplied through the channel.

Figure 5:
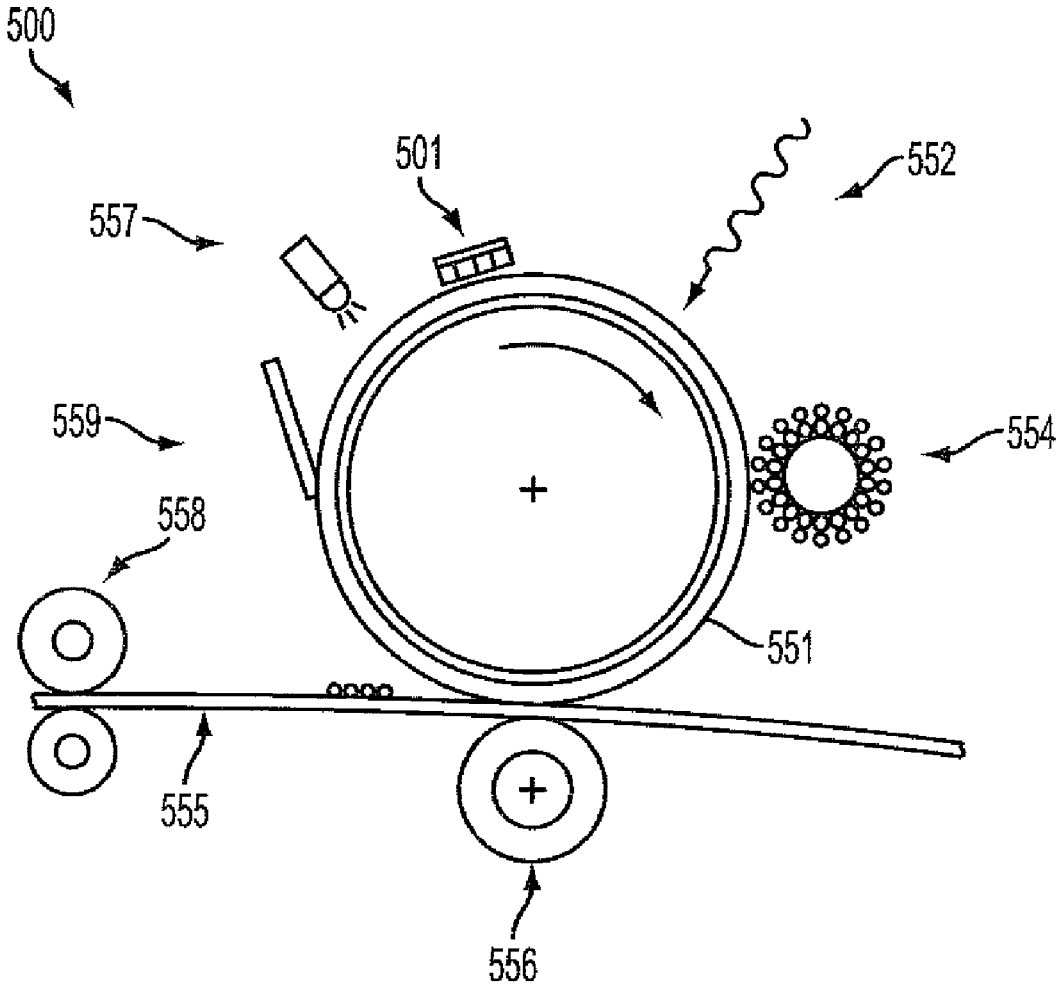
FIG. 5 illustrates an exemplary image forming apparatus, according to various embodiments of the present teachings.
Figure 6:
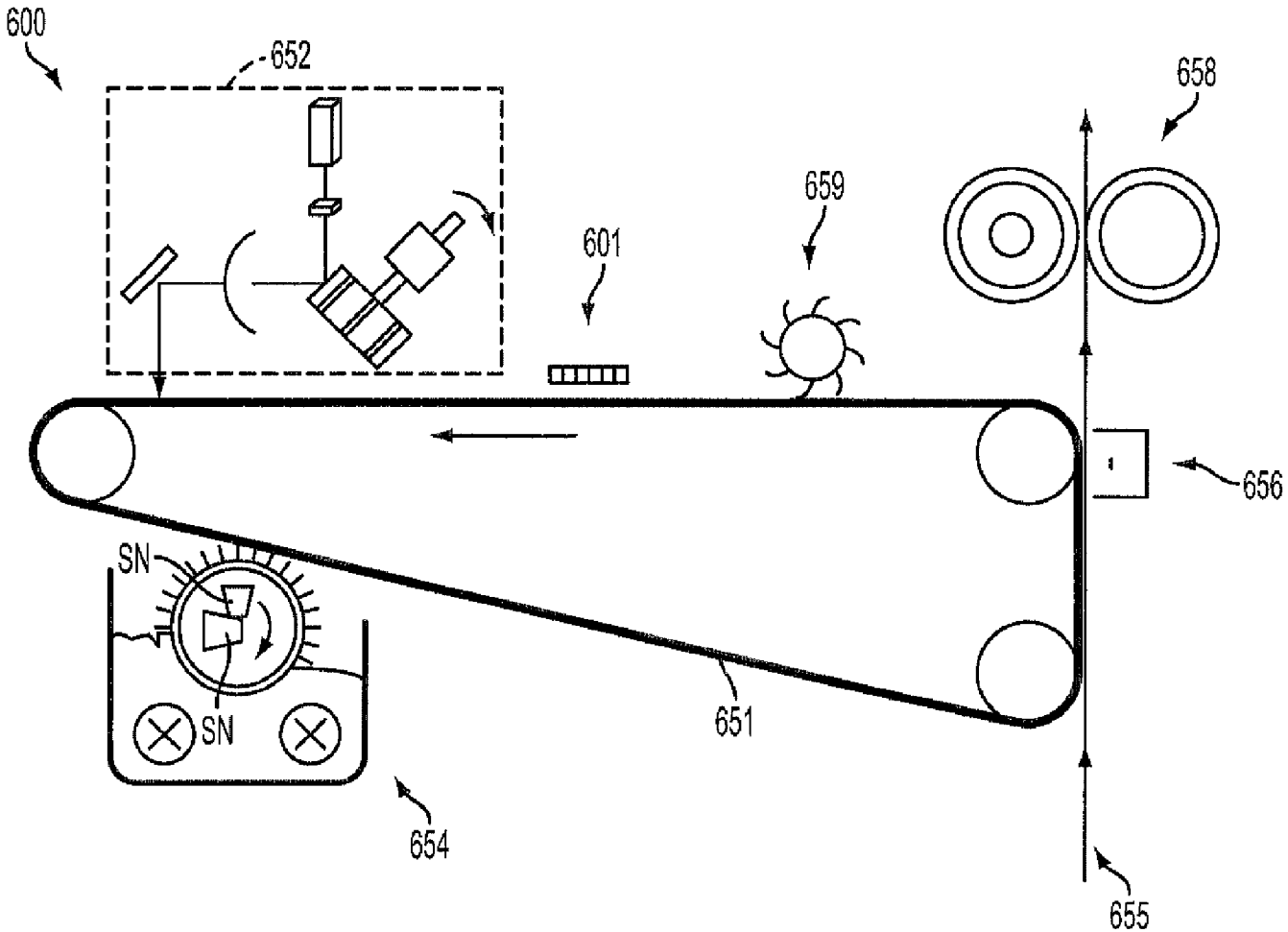
FIG. 6 illustrates another exemplary image forming apparatus, in accordance with the present teachings.

According to various embodiments, there is an image forming apparatus 500, 600, as shown in FIGS. 5 and 6. The image forming apparatus 500, 600 can include a receptor 551, 651 to receive an electrostatic charge. In some embodiments, the receptor 551, 651 can be a drum receptor 551, as shown in FIG. 5. In other embodiments, the receptor 551, 651 can be a belt receptor 651, as shown in FIG. 6. The image forming apparatus 500, 600 can also include at least one charging subsystem 501, 601 for uniformly charging the receptor 551, 651. The charging subsystem 501, 601, 101, as shown in FIGS. 1, 2, and 3 can include a first dielectric layer 107 disposed over a substrate 105, a first conductive layer 110 disposed over the first dielectric layer 107, and a second dielectric layer 120 disposed over the first conductive layer 110, the second dielectric layer 120 including a plurality of cavities 122, wherein each of the plurality of cavities 122 exposes a portion of the first conductive layer 110. In various embodiments, each of the plurality of cavities 122 can have any suitable shape including, but not limited to, a cylindrical shape and a wedge shape. The charging subsystem 501, 601, 101 can also include a plurality of micro-tips 130, wherein one of the plurality of micro-tips 130 can be disposed within each of the plurality of cavities 122 and on the first conductive layer 110. In various embodiments, each of the plurality of micro-tips 130 can be individually addressed. In certain embodiments, a group of micro-tips 130 can be selectively addressed. In certain embodiments, each of the plurality of micro-tips 130 can have any suitable shape including, but not limited to, conical, conical with a flat tip, cylindrical with a round tip, and cylindrical with a flat tip. The charging subsystem 501, 601, 101 can further include a second conductive layer 140 disposed over the second dielectric layer 120 and a system of interconnected air flow channels 124 disposed in the second dielectric layer 120 and connected to the cavities 122, such that air injected through an air inlet 125 exits through the plurality of cavities 122.

Referring back to the FIGS. 5 and 6, the image forming apparatus 500, 600 can also include at least one imaging subsystem 552, 652 to form a latent image on the receptor 551, 651 and at least one development subsystem 554, 654 for converting the latent image to a visible image on the receptor 551, 651. The image forming apparatus 500, 600 can further include a transfer subsystem 556, 656 for transferring the visible image onto a media 555, 655 and a fuser subsystem 558, 658 for fusing the visible image onto the media 555. 655. In various embodiments, the image forming apparatus 500, 600 can also include a cleaning subsystem 559, 659 and an erasing subsystem 557.

The charging device 101, 501, 601, as disclosed herein has numerous advantages over conventional charging devices, including small footprint, extremely long life, easy to clean, improved charge uniformity, environmentally friendly, modularity and scalability to high speed. One of ordinary skill in the art would know that small footprint is a key enabler for small-box engines and high-speed applications. And the disclosed charging devices 101, 501, 601 are replacement of conventional charging devices such as scorotron and biased charging roll as they are prone to contamination. Furthermore, in the disclosed charging devices 101, 501, 601, individual micro-tips 130 or a group of micro-tips 130 can be selectively addressed, which enables direct imaging of charge pattern onto the member 160.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A charging device comprising:

a first dielectric layer disposed over a substrate;

a first conductive layer disposed over the first dielectric layer;

a second dielectric layer disposed over the first conductive layer, the second dielectric layer comprising a plurality of cavities, wherein each of the plurality of cavities exposes a portion of the first conductive layer;

a plurality of micro-tips, wherein one of the plurality of micro-tips is disposed within each of the plurality of cavities and on the first conductive layer;

a second conductive layer disposed over the second dielectric layer and having a plurality of openings therein;

a system of interconnected air flow channels disposed in the second dielectric layer and connected to the cavities, wherein the system of interconnected air flow channels comprises a first channel having a first cross-sectional area which extends through the second dielectric layer between adjacent cavities and between adjacent micro-ties but not into one of the cavities and a plurality of second channels, each second channel having a second cross-sectional area, with each second channel extending from the first channel into one of the cavities and configured such that air injected through an air inlet exits one of the plurality of second channels laterally toward one of the plurality of micro-tips, through one of the plurality of cavities, and out through one of the plurality of openings in the second conductive layer, wherein the first cross-sectional area is larger than the second cross-sectional area; and one or more power supplies to apply a first bias voltage to the first conductive layer and a second bias voltage to the second conductive layer.

2. The charging device of claim 1, wherein the micro-tip has a shape selected from the group consisting of conical, conical with a flat tip, cylindrical with a round tip, cylindrical with a flat tip, and general curve shape.

3. The charging device of claim 1, the cavity has at least one of a cylindrical shape, a wedge shape, and a general curve shape.

4. The charging device of claim 1, wherein the one or more power supplies provide at least one, of DC power and pulsed DC power.

5. The charging device of claim 1, wherein the one or more power supplies provide at least one of AC power and biased AC power.

6. The charging device of claim 1, wherein each of the plurality of Micro-tips is individually addressable.

7. The charging device of claim 1, wherein each of the plurality of cavities, has a diameter from approximately 1 μm to approximately 200 μm.

8. The charging device of claim 1, wherein a spacing between each of the plurality of cavities is from approximately 3 μm to approximately 1000 μm.

9. The charging device of claim 1 further comprising a protective coating over the second conductive layer.

10. A device comprising the charging device of claim 1, wherein the charging device is used to raise a surface potential of a member.

11. A device comprising the charging device of claim 1, wherein the charging device is used for media treatment.

12. A method of charging a member, the method comprising:

providing a member to be charged;

providing a micro-tip array, the micro-tip array comprising:

a first dielectric layer disposed over a substrate;

a first conductive layer disposed over the first dielectric layer;

a second dielectric layer disposed over the first conductive layer, the second dielectric layer comprising a plurality of cavities, wherein each of the plurality of, cavities exposes a portion of the first conductive layer;

a plurality of micro-tips, wherein one of the plurality of micro-tips is disposed within each of the plurality of cavities and on the first conductive layer;

a second conductive layer disposed over the second dielectric layer and having a plurality of openings therein; and a system of interconnected air flow channels disposed in the second dielectric layer and connected to the cavities, wherein the system of interconnected air flow channels comprises a first channel having a first cross-sectional area which extends through the second dielectric layer between adjacent cavities and between adjacent micro-tips but not into one of the cavities and a plurality of second channels, each second channel having a second cross-sectional area, with each second channel extending from the first channel into one of the cavities such that air injected through an air inlet exits one of the plurality of second channels laterally toward one of the plurality of micro-tips, through the plurality of cavities, and out through one of the plurality of openings in the second conductive layer, wherein the first cross-sectional area is larger than the second cross-sectional area;

applying a first bias voltage to the first conductive layer and a second bias voltage to the second conductive layer to enable generation of a plurality of charged species; and charging a member by depositing the plurality of charged species on the member.

13. The method of claim 12, wherein the step of applying a first bias voltage to the first conductive layer and a second bias voltage to the second conductive layer comprises:

applying a first voltage and a second voltage, wherein a voltage differential between the first voltage and the second voltage is about 100 V or less; and generating a plurality of charges at an end of each of the plurality of micro-tips.

14. The method of claim 12, wherein the first bias voltage is one of a DC bias and a pulsed DC bias, and the second bias voltage is of a DC bias.

15. The method of claim 12, wherein the first bias voltage is one of an AC and a biased AC, and the second bias voltage is of a DC-bias.

16. The method of claim 12 further comprising grounding a portion of the member before the step of applying the first bias voltage and the second bias voltage.

17. The method of claim 12 further comprising grounding a backing plate before the step of applying the first bias voltage and the second bias voltage.

18. The method of claim 12, wherein the step of charging the member comprises charging at least one of a photoreceptor, a toner layer, a media, and an intermediate belt for electrostatic toner transfer.

19. The method of claim 12 further comprising cleaning the micro-tips by injecting air through the air inlet, wherein the injected air passes through the first channel between adjacent micro-tips, through one of the second channels, exits the one of the second channels laterally toward one of the micro-tips and into one of the plurality of cavities, and exits the cavity through one of the plurality of openings in the second conductive layer.

20. The method of claim 12, wherein the step of providing a micro-tip array comprises fabricating micro-tip array using microelectromechanical systems (MEMS) fabrication and semiconductor fabrication processes.

21. The method of claim 12, wherein the step of charging the member by depositing the plurality of charged species on the receptor comprises:

supplying a gaseous material between the micro-tip array and a counter electrode, such that application of a first bias voltage to the first conductive layer and a second bias voltage to the second conductive layer, and third voltage to the counter electrode ionizes at least a portion of the gaseous material; and directing the ionized gaseous material towards the member.

22. An image forming apparatus comprising:

a receptor to receive an electrostatic charge;

at least one charging subsystem for uniformly charging the receptor, the charging subsystem comprising:

a first dielectric layer over a substrate;

a first conductive layer over the first dielectric layer;

a second dielectric layer disposed over a first conductive layer, the second dielectric layer comprising a plurality of cavities, wherein each of the plurality of cavities exposes a portion of the first conductive layer;

a plurality of micro-tips, wherein one of the plurality of micro-tips is disposed within each of the plurality of cavities and on the first conductive layer;

a second conductive layer disposed over the second dielectric layer and having a plurality of openings therein; and a system of interconnected air flow channels disposed in the second dielectric layer and connected to the cavities, wherein the system of interconnected air flow channels comprises a first channel having a first cross-sectional area which extends through the second dielectric layer between adjacent cavities and between adjacent micro-tips but not into one of the cavities and a plurality of second channels, each second channel having a second cross-sectional area, with each second channel extending from the first channel into one of the cavities and configured such that air injected through an air inlet exits one of the plurality of second channels laterally toward one of the plurality of micro-tips, through the plurality of cavities, and out through one of the plurality of openings in the second conductive layer, wherein the first cross-sectional area is larger than the second cross-sectional area;

at least one imaging subsystem for forming a latent image on the receptor;

at least one development subsystem for converting the latent image to a visible image on the receptor;

a transfer subsystem for transferring the visible image onto a media; and a fuser subsystem for fusing the visible image onto the media.

23. The image forming apparatus of claim 22, wherein the micro-tip has a shape selected from the group consisting of conical, conical with a flat cylindrical with a round tip, cylindrical, with a flat tip, and a general curve shape.

24. The image forming apparatus of claim 22, wherein the cavity has at least one of a cylindrical shape, a wedge shape, and a general curve shape.

25. An image forming apparatus of claim 22, wherein each of the plurality of micro-tips is individually addressable.

* * * * *